United States Patent [19]

Skinner

[11] 4,422,196

[45] Dec. 27, 1983

[54] METHOD OF FORMING A TORQUE NUT

[75] Inventor: James H. Skinner, Birmingham, Mich.

[73] Assignee: Federal Screw Works, Detroit, Mich.

[21] Appl. No.: 225,800

[22] Filed: Jan. 16, 1981

[51] Int. Cl.[3] ..... B21D 53/24; B21K 1/70

[52] U.S. Cl. ..... 10/86 A; 10/86 F

[58] Field of Search ..... 10/86 R, 86 A, 86 F, 10/76 R; 411/276, 277, 281, 283, 284

[56] References Cited

U.S. PATENT DOCUMENTS

| | | | |
|---|---|---|---|
| 2,464,412 | 3/1949 | Neff | 10/86 A |
| 2,679,879 | 6/1954 | Engstrom | 10/86 A |
| 3,455,361 | 7/1969 | Zimmer et al. | 10/86 A |
| 3,456,704 | 7/1969 | Johnson | 10/86 A |
| 3,486,179 | 12/1969 | Beutler et al. | 10/86 A |
| 3,734,156 | 5/1973 | Beard | 10/86 A |

*Primary Examiner*—Ervin M. Combs

*Attorney, Agent, or Firm*—Harness, Dickey & Pierce

[57] ABSTRACT

A prevailing type torque nut, and method and apparatus for manufacturing such a nut. The nut is formed with two locally deformed locking portions which are formed in such a way that the remainder of the threads extending between the locking portions is substantially continuous, uninterrupted and undeformed. As a result, the nut offers greater control over the locking torque characteristics and permits a wider latitude of tolerances. In accordance with the method of forming the nut, the nut is locally deformed by applying pressure to its outer surface so that the threads will be displaced radially inwardly at localized portions. Means cooperate with the threads intermediate the locking portions to internally support the intermediate thread portions and thereby preclude any substantial deformation thereof during the forming operation. An apparatus for forming such lock nuts is disclosed which consists of an inner mandrel having a tapered outer section which corresponds in diameter to the crest diameter of the nut threads. Two reliefs are formed in the mandrel and a cooperating crimping tool is provided which engaged the outer surface of the nut in alignment with the recesses for deforming the nut material into the recesses of the mandrel.

7 Claims, 6 Drawing Figures

METHOD OF FORMING A TORQUE NUT

BACKGROUND OF THE INVENTION

This invention relates to an improved prevailing torque-type lock nut, and a method and apparatus for forming such a nut.

Metal prevailing torque-type lock nuts are generally well known. Conventionally, these nuts are formed with a locking area wherein the internal threads are upset or deformed to create a binding action with the stud or bolt upon assembly to preclude the likelihood of the nut working loose in use. Such prevailing torque-type lock nuts are normally formed by deforming the outer portion of the upper end of the nut radially inwardly so that the threads will be displaced in this area. Although numerous lock nut designs exist wherein the outer portion of the nut is deformed at three equally spaced locations around the periphery of the nut, it is generally recognized that a lock nut which is distorted on only two radially opposed sides thereof exhibits superior torque retention characteristics due to the greater resiliency of the nut body. Examples of such lock nuts are shown in U.S. Pat. No. 3,198,230 entitled Lock Nut issued Aug. 3, 1965, in the name of J. H. Stover III and in U.S. Pat. No. 3,455,361 entitled Torque Nut issued July 15, 1969, to D. R. Zimmer et al.

However, lock nuts with two-sided distortion have several disadvantages. For example, the localized deformation of the locking portion of the nut has a tendency to distort the shape of the hex unless the nut is held within a die or collet during deformation. Thus, tolerances must be quite closely held with such nuts so that when the locking operation is performed on them, they will not be deformed outside of the normal specification range for the nut. This must be done to insure that standard tools may be used with the finished nut. Furthermore, the amount of deformation will be dependent upon the initial size of the nut. Normal tolerances with such elements will cause wide variations in the actual torque locking characteristics of the finished nut. As a result, the tolerances on the nut prior to the formation of the locking surface thereon must also be quite closely held. In addition to the aforenoted defects, all of which go to the cost, the prior art type of prevailing torque lock nuts have had a tendency to abraid the cooperating fastener when put in place and have a tendency to substantially reduce their locking chacteristics each time they are assembled and disassembled due to the manner in which they are formed. Furthermore, it has been necessary with the prior art type of lock nuts to accurately control the pressure applied to the nut when the locking formations are being made so as to more accurately control the torque characteristics of the finished product.

It is, therefore, a principal object of this invention to provide an improved torque-type lock nut and method and apparatus for making such a lock nut.

It is another object of the invention to provide a prevailing torque-type lock nut that offers more accurate control over its torque locking characteristics.

It is a further object of this invention to provide an improved low cost prevailing torque-type lock nut and method and apparatus of making it which permits wider tolerances while controlling the torque characteristics.

It is yet a further object of this invention to provide an improved prevailing torque-type lock nut and method and apparatus of making it which permits a greater number of reuses without adversely affecting the torque locking characteristics of the nut.

BRIEF SUMMARY OF THE INVENTION

A first feature of this invention is adapted to be embodied in a female threaded torque fastener that comprises an outer body defining an internally threaded bore. The threads of the bore are substantially continuous and uninterrupted and terminate at a locking portion. The locking portion comprises a thread which extends from the uninterrupted thread and which is formed with at least one locking discontinuity in its shape. The discontinuity comprises a portion of the thrad which extends radially inwardly of the crest diameter of the uninterrupted portion of the thread. The threads of the locking portion other than the discontinuity are substantially uniform and have the same root, crest and pitch diameter as the continuous portion of the threads.

Another feature of this invention is adapted to be embodied in the method of forming a female threaded torque fastener. The method comprises the steps of forming a continuous uninterrupted female thread in a member and deforming localized portions of the thread radially inwardly of the crest diameter of the undeformed threaded portions. Deformation of the portions of the thread adjacent the deformed localized portions is substantially precluded by internally supporting the undeformed thread portions during the deformation process.

Still a further feature of this invention is adapted to be embodied in a tool for forming a torque fastener. The tool comprises a mandrel having an outer surface which conforms substantially to the diameter of the finished threads of the female threaded member. A relief extending in an axial direction is formed in at least one part of the mandrel. A crimping tool is associated with the mandrel and has an inner surface that is substantially continuous with an interrupted radially inwardly extending portion formed in alignment with the mandrel recesses for deforming the associated female threaded fastener in the localized area while the mandrel substantially precludes deformation other than in the interrupted area.

DETAILED DESCRIPTION OF THE PREFERRED EMBODIMENT

Figure 1:
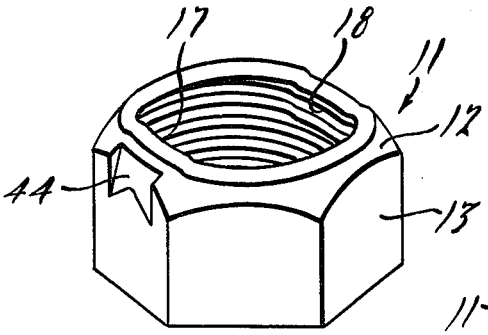
FIG. 1 is a perspective view of a prevailing torque-type lock nut embodying this invention.
Figure 3:
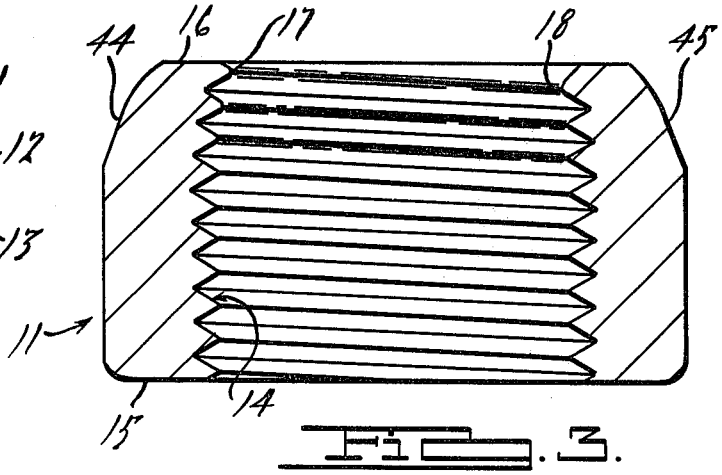
FIG. 3 is an enlarged cross-sectional view taken along the line 3—3 of FIG. 2.
Figure 2:
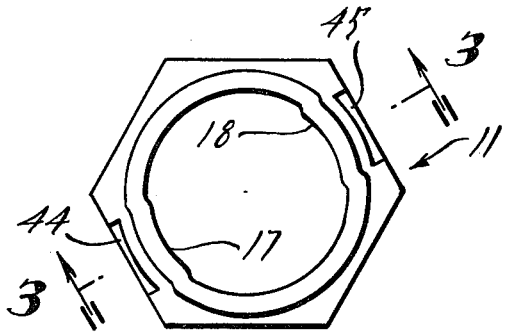
FIG. 2 is a top plan view of the nut showing the locking portion in an exaggerated form for the purpose of illustration.

In FIGS. 1 through 3, a prevailing torque-type lock nut constructed in accordance with this invention is identified generally by the reference numeral 11. In the illustrated embodiment, the nut 11 is of the crowned type and has a generally conically shaped section 12 formed at the upper or locking end above the hex surface 13. Although the invention is described in conjunction with a crown type of lock nut, as will become apparent as this description proceeds, the invention is equally adaptable for use with flange, collar, or flat type nuts. In addition, while the preferred embodiment of the lock nut illustrated in the drawings is distorted on two radially opposed sides thereof, it will be appreciated that the present invention is readily adaptable to produce a greater or lesser number of side distortions in the nut.

The nut 11 is formed with a single continuous internal thread, indicated generally by the reference numeral 14. The thread 14 is continuous and uninterrupted from the nut lower surface 15 to approximately 3 turns from its upper surface 16. This upper portion comprises the locking portion of the nut 11. The threads in the locking portion are continuous and uninterrupted except at a pair of diametrically opposed locking areas indicated by the reference numerals 17 and 18. The amount or radial inner extent of the deformed portions 17 and 18 has been exaggerated in the drawings for the sake of illustration. In the deformed portion the threads have not been significantly changed in shape but, merely, have been radially inwardly displaced from the remaining portion of the thread 14. In the area between the deformed portions 17 and 18, the threads 14 have not been deformed or otherwise changed in shape. This is accomplished by means of the method and tool now to be described.

As has been noted, U.S. Pat. Nos. 3,198,230 and 3,455,361 show prior art types of locking nuts with two-sided distortions. In connection with the locking nuts shown in those patents, the locking formations are formed by exerting sufficient pressure in the radial direction on the external surface of the nut in the area adjacent diametrically opposed flats so as to cause deformation of the threads. When this is done, however, the metal displaced will also cause the exterior surface of the nut to change slightly in shape, unless the nut is held within a die or collet during deformation as shown in the U.S. Pat. No. 3,455,361, which then complicates the distortion operation. Otherwise, the cornes of the nut displaced 90 degrees from the locking portions have a tendency to increase in major diameter while the distance between the flats in which the locking portions are formed has a tendency to decrease. That is, the nut will assume a generally oval shape. As a result of this deformation, it has been previously the practice to form this type of locking nut from a conventional nut that is either somewhat undersized or at the bottom end of the tolerance range for its external dimensions. Thus, when the deformed nut is finished it is hoped that it will still remain within the tolerance for the standard nut so that wrenches and conventional tools will fit upon it. Of course, this closer holding of tolerances adds significantly to the cost and furthermore increases the rejection rate.

Furthermore, with the prior art type of devices, the actual amount of deformation of the threads will have a direct relationship on the initial size of the nut. The larger the nut, the greater amount of deformation and hence the locking torque exerted by the nut will vary depending upon its initial size. In order to maintain closer tolerances for locking torques, a closer tolerance of the initial nut was required with the prior art type of devices, hence, adding to their cost.

The prior art devices also have not specifically lent themselves to making locking nuts out of flat nuts due to the possibility of greater deformation for the reasons noted above. A further disadvantage with the prior art type of devices is that the total deformation of the nut in the locking area has a tendency to abrade the associated bolt upon installation, and furthermore, causes high wear in the locking portion which greatly reduced the torque characteristics of the nut upon disassembly and subsequent reapplications. The prior art methods also require close tolerances between the diameter of the finished threads and the hex surface which could only be held by piercing the bore from which the thread would be formed while the nut was held in a die.

In accordance with this invention, the locking portions 17 and 18 are formed in such a way their shape can be accurately controlled and at the same time deformation of the threads 14 is the area outside of the locking portions 17 and 18 is substantially precluded. Furthermore, the hex portion 13 is not distorted significantly during this operation and it is, therefore, possible to use nuts having a wider tolerance range than was previously possible when making locking nuts. Furthermore, because the torque locking characteristics may be more accurately controlled with the method and apparatus hereindisclosed, it is possible to make the locking nut from a lower grade of material. This offers further cost reduction and furthermore permits longer life for the associated tooling.

Referring now to the remaining figures, a tool for making the nut shown in FIGS. 1 through 3 is identified generally by the reference numeral 21. The tool 21 is adapted to be installed in a suitable press or other forming tool and consists of an outer, crimping tool, indicated generally by the reference numeral 22, and an inner mandrel, indicated generally by the reference numeral 23. The crimping tool 22 has a small diameter cylindrical portion 24 and a lower end with a larger diameter cylindrical portion 25. A bore 26 extends from near the top end of cylindrical portion 24 and terminated adjacently the lower end of the portion 25. The lower end of the bore 26 terminates in a generally conically shaped section 27 into which extend a pair of isolated projections 28 and 29. The projections 28 and 29 are generally inclined relative to the axis of the bore 26 of the tool 22 and have a width which is chosen so as to provide the desired amount of locking area, to provide the desired amount of locking torque. In a preferred embodiment of the invention the incline of the projections 28 and 29 is at approximately a twenty degree angle to the normal or vertical axis of the tool 22 to provide an included angle of forty degrees. This is a lesser angle than has been previously employed for this purpose and is possible due to the controlled deformation. However, for low height nuts, it may be desirable to increase the angle of inclination of the projections 28 and 29 to limit the depth or distortion of the locking projections 17 and 18 in the finished nut 11. In addition it will be noted that the sides of the projections 28 and 29 are parallel along their entire length to minimize metal flow beyond the deformed areas 44 and 45 of the nut 11.

The mandrel 23 has a cylindrical part 31 that extends through the bore 26 and terminates in a threaded portion 32 onto which a nut 33 is turned. The mandrel has, adjacent its lower end, a cylindrical portion 34 which is complimentary to the bore 26 for slidably supporting and locating the mandrel 23 in the bore 26. A die spring 35 is positioned in the bore 26 and bears against a shoulder 36 formed at the base of the bore 26 and a shoulder 37 formed at the upper end of the cylindrical portion 34 of the mandrel 23. The nut 33 contacts the upper surface of the crimping tool 21 so as to limit the expansion between these two parts under the influence of the die spring 35.

The cylindrical part 34 is also formed with longitudinally extending key ways 38. A pin 39 is staked to the crimping tool 22 and extends into one of the key ways 38 to hold the mandrel 23 in a fixed angular position relative to the crimping tool 22.

The lower end of the mandrel 23 below the cylindrical portion 34 is formed with a tapered nosepiece 41. The nosepiece is tapered at about two and one half degrees relative to the longitudinal axis and has its smallest diameter portion just slightly smaller than the minimum diameter of the tolerance range of the nut to be formed into locking nuts in accordance with this invention. On opposite sides, the tapered portion 41 is formed with a pair of key shaped recesses 42 and 43 which are slightly larger in width than the projections 28 and 29 of the crimping tool 22. The recesses 42 and 43 are aligned with and of the same width as the key ways 38 and are also tapered at approximately the same angle as the taper of the surface 41. The depth of the recesses 42 and 43 is chosen so as to provide the desired control over the deformation of the locking portions 17 and 18 of the resulting locking nut. That is, if no deformation to the crest of the threads is required, the depth of the grooves or recesses 42 and 43 should be sufficiently deep so as to permit complete metal deformation into this area without contact with the base of the recesses. If, on the other hand, it is desired to control the amount of inward displacement and/or to effect a flattening of the crest of the threads of the locking portions 17 and 18, the depth of the grooves or recesses 42 and 43 should be reduced accordingly. The height of the projections 28 and 29 and depth of the recesses 42 and 43 can each be altered so as to achieve the desired amount of deformation and, accordingly, the desired amount of locking torque exerted by the finished nut 11.

In operation, nuts 11 are placed on the press or associated tool beneath the ram which carries the tool 21. Due to the tapering of the mandrel nose piece 41 and that of the lower opening 27 of the crimping tool 22, accurate location of the nut relative to the tool 22 is not particularly important. The tapering of the forming tool surfaces will provide such final location as may be required.

Figure 4:
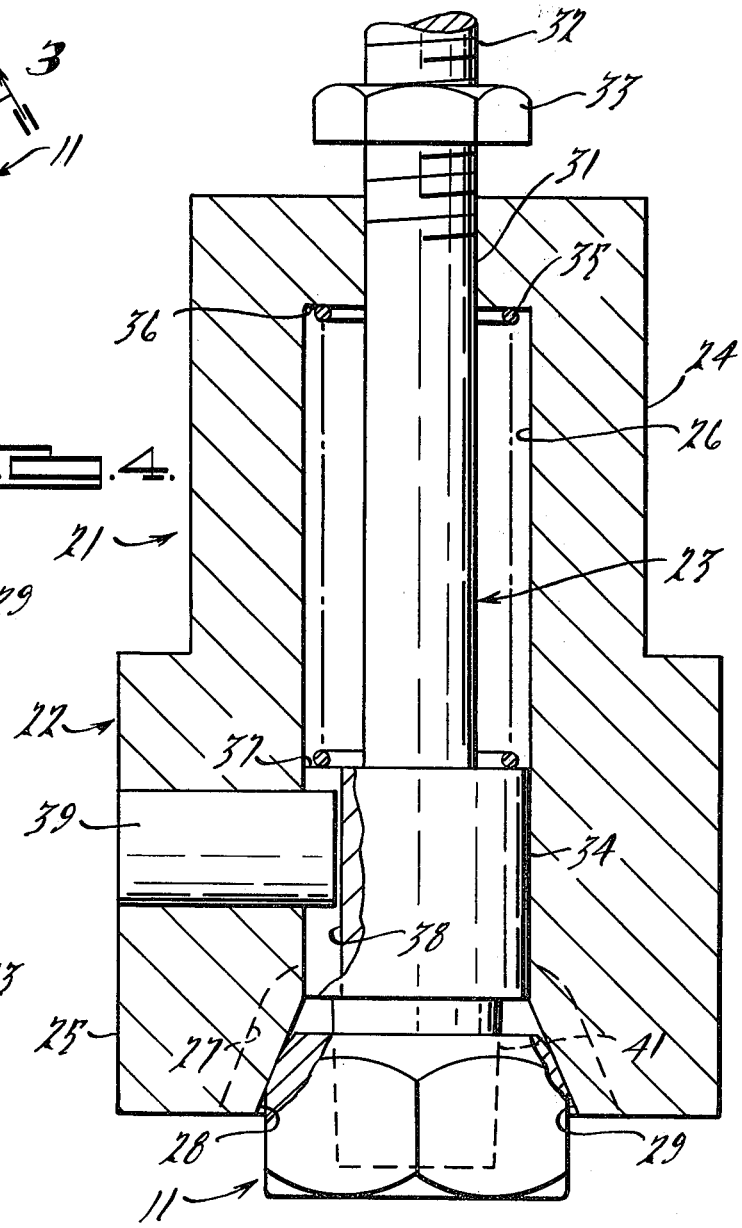
FIG. 4 is a cross-sectional view taken longitudinally through a forming tool particularly adapted for forming the nut shown in FIGS. 1 through 3.
Figure 5:
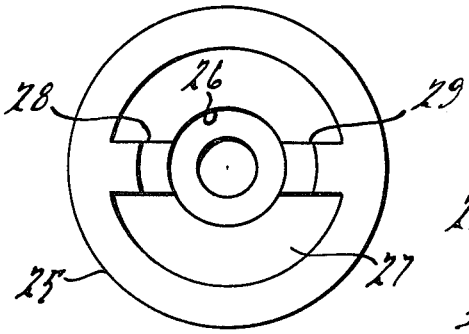
FIG. 5 is a bottom plan view of the crimping tool shown in FIG. 4.
Figure 6:
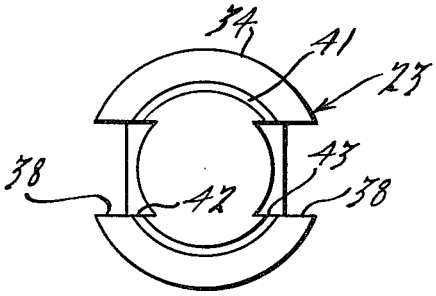
FIG. 6 is a top plan view of the mandrel shown in FIG. 4.

When the nut is in place, the ram is actuated so that the tool moves downwardly in a direction aligned with the axis of the nut 11. At this stage, the mandrel 23 will be extended to a greater degree than as shown in FIG. 4, which shows the tool at the end of its forming operation, due to the action of the die spring 35. The nose portion 41 of the mandrel will enter the opening of the nut first and will move the nut to a position wherein the tapered portion 41 will be aligned with the crest diameter of the finished threads of the nut. The nose portion 41 of the mandrel will continue to move downwardly relative to the associated nut 11 until the crest of the uppermost threads is contacted by the tapered surface of the nose piece 41. The point at which this occurs will depend upon the actual diameter of the threads of the nut, as has been previously noted. Upon further downward movement of the ram, the mandrel 23 will be held in position through its engagement with the crest of the threads and the die spring 35 will yield. The projections 28 and 29 of the crimping tool 22 will then engage the nut and displace the metal inwardly to form locking recesses 44 and 45 in its outer surface (FIGS. 1 through 3). The metal displaced by forming the recesses 44 and 45 will be forced to flow into the recesses 42 and 43 of the mandrel 31 inasmuch as the conical portion 41 of the mandrel will preclude any deformation of the threads 14 in the area surrounding the recesses 42 and 43. In addition, it will be appreciated that metal flow is further restricted substantially to the deformation sites by virtue of the fact that the recesses 44 and 45 formed by projections 28 and 29 define parallel-sided inclined surfaces which extend from the top surface of the nut 11 to a sidewall thereof. It should be thus readily apparent that the locking projections 17 and 18 are formed without upsetting or changing the configuration of the remainder of the threads. Also, since the remaining portion of the thread 14 is not deformed, the hex 13 of the nut as well as the remaining conical portion 12 will not be deformed.

The use of tapered surfaces for the mandrel and the crimping tool also accommodates size variations within a given tolerance range and control in the total amount of deformation. As a result, greater latitude in the pressure applied by the associated press is possible than with prior art type of methods. Moreover, because metal flow is restricted by the mandrel 31, a more uniform amount of radially inward deflection in the pitch diamter of the nut 11 is realized, thus providing more consistent torque characteristics despite tolerance variations in the nut.

The invention has been described in conjunction with a conical type of nut. Unlike the prior art, this invention adapts itself to use with flat type of nuts also inasmuch as the deformation of the locking portions of the nut is more accurately controlled. It should be readily apparent from the foregoing description that this tool and method result in a formation of a nut which has the superior characteristics set forth herein. Of course, various changes and modifications may be made without departing from the spirit and scope of the invention, as defined by the appended claims.

I claim:

1. The method of forming a female thread torque fastener comprising the steps of forming a contiguous, uninterrupted female thread in a member defining a threaded hole therein, inserting a mandrel into said threaded hole of said member, said mandrel having at least one recess portion and portions adjacent said recess portion for contacting the crest of said thread in said member to internally support said thread, and deforming at least one localized portion of said thread radially inwardly into said recess portion of said mandrel, while simultaneously substantially precluding deformation of said thread adjacent said locally deformed portion by internally supporting said thread by said adjacent portions of said mandrel.

2. The method as set forth in claim 1, wherein said mandrel contains two diametrically opposed recess portions with the portions thereof intermediate said recess portions contacting the crest of the thread of said member upon insertion of said mandrel into the threaded hole in said member, and further wherein two diametrically opposed localized portions of said thread are deformed radially inwardly into said recess portions of said mandrel.

3. The method as set forth in claim 1, wherein the steps of inserting said mandrel into the threaded hold of said member and deforming said localized portion of said thread in said member are performed substantially simultaneously.

4. The method as set forth in claim 2 further including the step of flattening the crests of said localized portions.

5. The method as set forth in claim 2 wherein said localized portions are deformed by applying radially inward pressure to the outer surface of the female threaded member in said area of the localized portions.

6. The method as set forth in claim 5 wherein sufficient pressure is applied to bring said deformed portions of said thread into engagement with a base portion of said mandrel recesses.

7. The method as set forth in claim 5 wherein said female threaded fastener comprises a nut and said localized portions are formed in the area of said flats of the nut.

* * * * *